United States Patent [19]

Brown

[11] 4,296,529

[45] Oct. 27, 1981

[54] BAG SEALING DEVICE

[76] Inventor: Stanley E. Brown, P.O. Box 69, Harriman, N.Y. 10926

[21] Appl. No.: 56,445

[22] Filed: Jul. 11, 1979

[51] Int. Cl.[3] ..... B65D 77/10

[52] U.S. Cl. ..... 24/30.5 P; 24/30.5 S

[58] Field of Search ..... 24/30.5 R, 30.5 P, 16 PB, 24/258; 292/319, 320

[56] References Cited

U.S. PATENT DOCUMENTS

| | | | |
|---|---|---|---|
| 2,818,871 | 1/1958 | Beaudry | 24/30.5 P |
| 3,001,254 | 9/1961 | Schumm | 24/30.5 PB |
| 3,036,506 | 5/1962 | Andresen, Jr. | 24/30.5 R X |
| 3,363,293 | 1/1968 | Nemrod et al. | 24/30.5 P |
| 3,551,965 | 1/1971 | Gordon | 24/30.5 R X |

FOREIGN PATENT DOCUMENTS

| | | | |
|---|---|---|---|
| 49475 | 3/1889 | Fed. Rep. of Germany | 24/30.5 R |
| 1477737 | 3/1967 | France | 24/30.5 R |
| 9253 | of 1852 | United Kingdom | 24/30.5 R |

*Primary Examiner*—Roy D. Frazier
*Assistant Examiner*—Peter A. Aschenbrenner
*Attorney, Agent, or Firm*—Ronald S. Cornell

[57] ABSTRACT

A device for temporarily sealing flexible bags comprises paired linear strips hingeably connected which define on their adjacent surfaces cooperating structures adapted to grippingly engage and lock a bag along its entire girth in an airtight manner. A locking clasp is provided at the distal ends of the strips to hold the device in the locked position. The strips are of unequal length to facilitate unlocking of the device to release the bag.

8 Claims, 5 Drawing Figures

BAG SEALING DEVICE

BACKGROUND OF THE INVENTION

The present invention relates generally to closures for bags, and more particularly to airtight closures useful for resealing bags containing perishable goods.

Presently, a variety of closures are known that are employed to seal flexible bags, commonly in use today in connection with the storage of foodstuffs, garments and the like. In applications where sealing of such bags is desirable, the contents of the bag has been found to degrade in contact with atmospheric air. Thus, foodstuffs are known to become stale, while garments may become soiled and mechanical devices become fouled in contact with air, particularly air carrying moderate levels of particulate pollutants. In all instances, it is desirable to maintain airtight closure of such bags until it is desired to use the contents. Further, the closure device should be capable of being reused to reestablish the airtight securement of the bag, in the event that either the contents of the bag has not been fully expended or new materials have been inserted therein.

Certain closures are known in the prior art which attempt to address the problems expressed above. Thus, U.S. Pat. No. 3,571,861 to Olson discloses a one piece molded plastic clip comprising a flat strip having a hinge medially provided therein and a locking means comprising a projection and mating recess disposed for cooperation at the respective free ends thereof. The Olson device further defines a ridge extending along the inner surface of one of the legs which places pressure against the flexible bag being held therebetween. Likewise, U.S. Pat. No. 3,363,293 to Nemrod et al discloses a bag tie which employs a continuous strip defining on the mating inner surfaces thereof a bag engaging clasp which defines paired arms mating with a singular projection to secure the crimped end of the bag therein. Finally, U.S. Pat. No. 3,629,905 to Cote disclosing a linear clamping device having a spring urging two flat members toward each other to apply pressured securement to a bag inserted therebetween.

All of the aforenoted devices have been found to possess certain deficiencies. Thus, both the Olson device and the device of Cote rely upon lateral pressure imposed upon the surfaces of the bag to secure the bag an airtight sealed engagement. Frequently however, the bags thus inserted are not perfectly flat and therefore certain air spaces will remain despite the pressure imposed by the paired arms or strips, with the result that some slippage of the clasp may occur and certain movement of the ends of the bag may result in the seepage of air therein.

The device defined in Nemrod et al partially addresses this problem by providing some securement which appears capable of rigidly securing the ends of the bag. Nemrod et al, however, fails to secure the bag at all points along its girth by virtue of the size of the clasping member, with the consequence that air seepage appears possible during the locking engagement of the bag.

The present device is designed and constructed to overcome the aforenoted deficiencies.

SUMMARY OF THE INVENTION

In accordance with the present invention, a closure device is disclosed for temporarily sealing flexible bags which comprises a pair of longitudinally extended arms hingeably connected at one end thereof and provided at the opposite ends thereof with a locking means comprising a male snap lock element and a corresponding female snap lock element. The device also includes a clasp assembly located along the adjacent inner surfaces of the arms which comprises a longitudinally extended upwardly projecting ridge, and a mating longitudinally extended recess or slot located on opposite surfaces which forces the portion of the bag held therebetween into crimped, airtight engagement therewith. One of the arms is longer than the next to facilitate the disengagement of the snap lock assembly. In the instance where the closures are prepared from a flexible, resilient material, the arms defining the longitudinal recess is of greater thickness and is provided with at least one longitudinal rib disposed on the outer surface thereof for reenforcement, and to prevent flexure permitting disengagement of the bag.

The design of the present closure device facilitates one piece manufacture in the instance where a flexible plastic material is contemplated. The device may be used repeatedly, and is easily operated with a minimum of manipulation.

The design of the clasping member facilitates the airtight engagement of a flexible bag along the entire girth thereof, as the design of the present device facilitates the engagement of a bag surface which has been laterally extended and made more amenable to crimping.

Accordingly, it is a principal object of the present invention to provide a closure useful in resealably securing flexible bags in an airtight manner.

It is a further object of the present invention to provide a closure as aforesaid which provides a positive, airtight sealing engagement of the bag along the entire girth thereof.

It is a yet further object of the present invention to provide a closure as aforesaid which is easily operated with a minimum of motion and effort.

It is a yet further object of the present invention to provide a closure as aforesaid which may be inexpensively and easily manufactured as an integral unit.

Other objects and advantages will become apparent to those skilled in the art from a consideration of the ensuing description which proceeds with reference to the following illustrative drawings.

DETAILED DESCRIPTION

Figure 1:
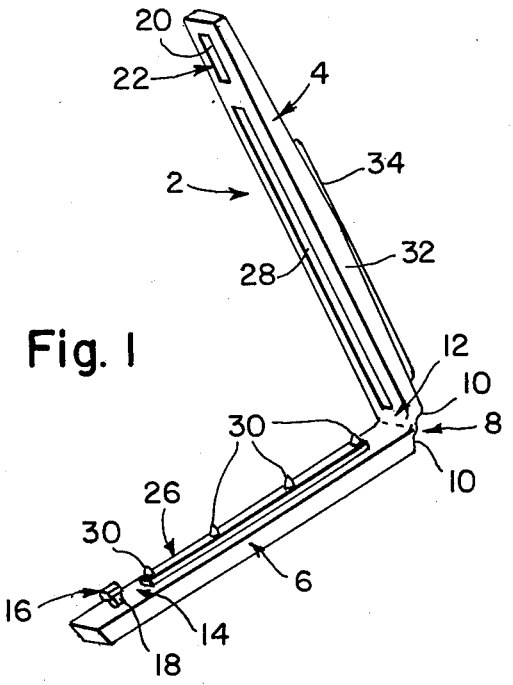
FIG. 1 is a perspective of the closure of the present invention displayed in the open position.

Referring now to the Figures wherein like numerals designate like parts, FIG. 1 illustrates a closure device 2 which comprises a first longitudinally extended arm 4 and a second longitudinally extended arm 6 connected to each other by a hinge 8 which may, as illustrated, comprise a strap of material integral with arms 4 and 6 and of reduced thickness therefrom. The present illustrated embodiment is preferred and comprises the appearance of closure device 2 in the instance where it is constructed from an inexpensive molded plastic material, such as polypropylene or the like. Naturally, however, the present invention is not limited to the provision of closure 2 in this form, but rather contemplates the manufacture and construction of the closure from other materials and in other ways.

Figure 3:
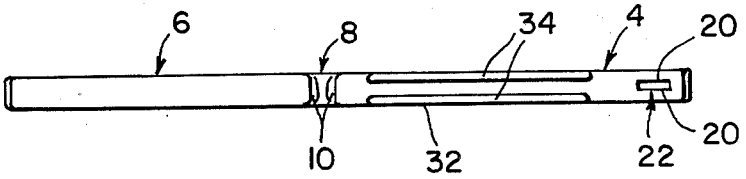
FIG. 3 is an elevational view of the closure of FIG. 2 showing the outer surfaces thereof.
Figure 4:
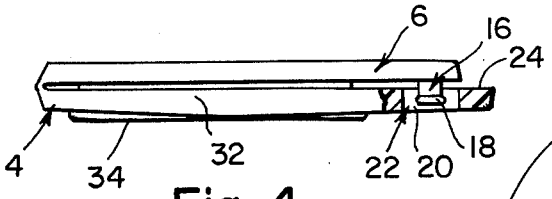
FIG. 4 is a side view partly in section showing the closure of FIG. 1 in the engaged position.

Hinge 8 is so constructed as to permit arms 4 and 6 to pivot into overlying engagement with each other, as illustrated in FIG. 4. One of the features of the present invention comprises the provision of beveled surfaces 10 disposed on the ends of arms 4 and 6 adjacent hinge 8. Beveled surfaces 10 permit arms 4 and 6 to flex through a full arc of 180°, and thereby prevent the premature exhaustion or snapping of hinge 8 in the instance where the closure of the present invention is constructed as noted above from a unitary, resilient plastic material. Beveled surfaces 10 nevertheless provide limited flexure of arms 4 and 6 beyond the 180° disposition shown in FIGS. 2 and 3, to prevent fracture resulting from accidental application of excessive force to disengage the closure.

Arms 4 and 6 respectively define inner surfaces 12 and 14 which are adapted as shown in FIG. 4 for disposition adjacent each other when arms 4 and 6 are located in stacked disposition. Surfaces 12 and 14 define on the portions thereof adjacent to free ends of arms 4 and 6 a locking assembly comprising a male snap lock element 16 which projects upwardly and defines at its end an increased diameter head 18. Head 18 is laterally enlarged to frictionally engage the lateral walls 20 of the longitudinal slit comprising female snap lock element 22. Thus, locking engagement is achieved by the application of finger pressure to the respective free ends of arms 4 and 6 adjacent snap lock elements 16 and 22. Though snap lock elements 16 and 22 have been illustrated in position adjacent respective arms 6 and 4, it is to be understood that this disposition may be reversed within the scope of the present invention. Thus, the foregoing description and accompanying Figures should be considered as illustrative rather than limitative of the present invention.

The locking assembly of the present invention includes a means for disengaging snap lock elements 16 and 22 comprising a longitudinal extension 24 disposed adjacent female snap lock element 22, as illustrated clearly in FIG. 4. Thus, disengagement of the snap lock elements may be accomplished by applying parting pressure against extension 24 to pry it away from arm 6, while securely holding the remainder of closure 2 in the opposite hand. The snap lock elements will disengage upon the application of moderate force to permit the removal of the secured bag from closure device 2.

Referring further to the Figures, closure device 2 further includes a clasping assembly comprising an elongated ridge 26 which extends upwardly, as illustrated, along surface 14. Ridge 26 is adapted to engage mating extended slot 28 which is disposed on the opposite inner surface. Naturally, as with snap lock elements 16 and 22, the location of ridge 26 and slot 28 on a particular arm is not critical. The present description and accompanying Figures is therefore presented for purposes of illustration only.

Figure 2:
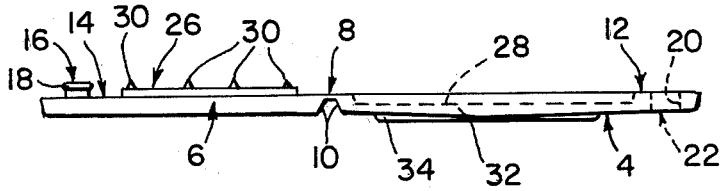
FIG. 2 is a side view partly in phantom illustrating the closure of the present invention in the fully opened position.

Referring futher to the Figures, and particularly FIGS. 1 and 2, ridge 26 nests within slot 28 to securely engage the entire girth of a bag placed therebetween. It can be seen that the nature of the crimp placed in the surface of the bag by the engagement of the present clasping assembly prevents the movement of air either into or out of the bag during the time that it is sealed. Further, the nature of the crimping engagement provided by the present clasping assembly prevents the bag surfaces from slipping out of engagement during securement. In this connection, ridge 26 may be provided with regularly spaced teeth 30, as illustrated, which further deform the surface of the bag to provide additional securement thereof within closure 2. This design clearly provides an airtight seal along the entire surface of the bag which prevents either the ingress or egress of air, even in instances where extended storage is contemplated.

The clasping assembly of the present invention further includes a reinforcement element disposed on the arm defining slot 28, for the purpose of maintaining the rigidity of that arm during the engagement of a bag. Thus, as illustrated, arm 4 is provided with an increased thickness support 32 which is disposed adjacent slot 28 along the outer surface of arm 4. Referring further to FIGS. 1–4, support 32 may be supplemented by paired reinforcing ribs 34 to assure in combination that an adequate stiffness is imparted to the arm defining slot 28 to withstand the repeated flexure and distension that occurs in use.

Figure 5:
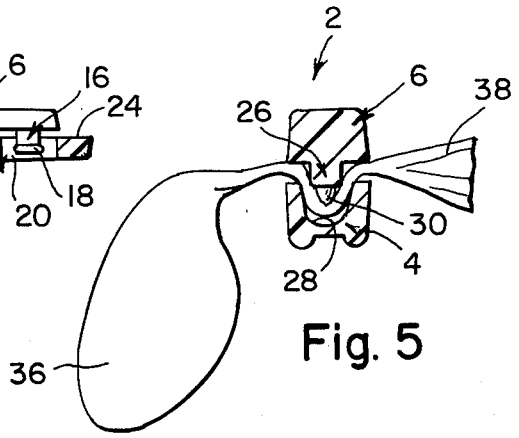
FIG. 5 is an end sectional view of the closure of FIG. 4 illustrative the grasping assembly attracted to a bag.

Referring now to FIG. 5, closure 2 is shown in section in operation sealably securing a bag 36. The end 38 of bag 36 protrudes from one side of closure 2 and is seen to be crimped into a substantially U-shape by the cooperative action of ridge 26 and slot 28. Teeth 30 can be seen to impinge upon the surface of bag 36 to further restrain the bag within the present clasping assembly. It is easy to see that the crimping imparted to bag 36 renders it impossible for air to enter or escape during sealing engagement.

As noted earlier, the closure device of the present invention is of simple construction, and particularly in the instance where it is prepared from inexpensive plastic materials, can be manufactured as an integral, unitary structure by such well known techniques as injection molding and the like. Although the above description has proceeded with reference to the employment of the present closure in the sealing engagement of bags, it is to be understood that the closure may be employed in a diverse number of applications, such as the securement of paired garments such as socks, gloves amd the like during merchandising, and as a disposable catheter clamp in surgical applications.

The present closure may be manufactured in a variety of sizes to suit any of the aforenoted applications. Also the closure may be constructed with its various elements, such as the clasping assembly and the locking assembly, located on either of the respective arms without limitation or adverse effect upon its operation.

It is to be understood that the invention is not limited to the illustrations described and shown herein, which are deemed to be merely illustrative of the best modes of carrying out the invention, and which are suitable of modification of form, size, arrangement of parts and details of operation. The invention rather is intended to encompass all such modifications which are within the spirit and scope and defined by the claims.

What is claimed is:

1. A closure device for temporarily sealing flexible bags comprising:

first and second longitudinally extended arms, each arm having an outer end and an inner end and at least one substantially flat inner surface, a hinge connecting said arms at the inner ends thereof, permitting said arms to pivot in one direction into stacked disposition with said inner surfaces disposed adjacent to each other, a locking assembly disposed on said inner surfaces adjacent to the outer ends of said arms comprising an upwardly projecting male snap lock element located on the inner surface of one of said arms, and a female snap lock element disposed within the inner surface of the other of said arms, said female snap lock element comprising an opening defined primarily by parallel walls being adapted to receive and releasably engage said male snap lock element therein, a clasping assembly located along said inner surfaces comprising an elongated longitudinal ridge extending along the inner surface of one arm and a longitudinal slot disposed matingly with said ridge along the opposite adjacent inner surface of the other arm, said slot extending only partially through said arm and being adapted to seat said ridge to crimpingly engage the entire girth of said bag, longitudinally extending reinforcement means located on the outer surface of and being integral with the arm defining said slot being parallel to said slot to maintain the stiffness of said arm when said slot and said ridge engage the surface of said bag, and release means located at the free end of one of said arms to disengage said locking assembly and release said bag.

2. The closure device of claim 1 further comprising paired beveled surfaces disposed on the inner ends of said arms adjacent said hinge to permit the limited movement of said arms to define an angle greater than 180° and to assist said hinge in resisting fracture caused by the application of excessive disengaging force against said locking assembly.

3. The closure device of claim 1 further including a plurality of teeth located along the leading edge of said ridge to assist in the securement of said bag between said ridge and said slot.

4. The closure device of claim 1 wherein said reinforcement means comprises paired, longitudinally extending ribs disposed on the arm defining said slot and located on the surface parallel to said inner surface.

5. The closure device of claim 1 wherein said female snap lock element and said slot are located on the same inner surface.

6. The closure device of claim 1 wherein said release means comprises a longitudinal extension of one of said arms whereby said arm is made greater in length.

7. The closure device of claim 1 wherein said release means is located adjacent said female snap lock element along a common inner surface.

8. The closure device of claim 1 wherein said device is prepared from an organic resinous material.

* * * * *